US005676793A

United States Patent [19]

Martin et al.

[11] Patent Number: 5,676,793

[45] Date of Patent: Oct. 14, 1997

[54] DRYWALL MUD APPLICATOR

[76] Inventors: Ricky W. Martin, 6727 Oak Cluster, Greenwell Springs, La. 70739; Casey M. Weeks, HC 86 Box 9AA, Sicily Island, La. 71368

[21] Appl. No.: 595,197

[22] Filed: Feb. 1, 1996

[51] Int. Cl.[6] ..... B32B 31/00

[52] U.S. Cl. ..... 156/578; 156/575; 118/123; 118/405; 118/423

[58] Field of Search ..... 118/123, 405, 118/419, 423, 425; 156/575, 577, 578, 579

[56] References Cited

U.S. PATENT DOCUMENTS

| | | | |
|---|---|---|---|
| 2,763,237 | 9/1956 | Harris | 118/419 X |
| 3,112,225 | 11/1963 | Harms | 118/405 X |
| 3,496,909 | 2/1970 | Bennett, Jr. | 156/578 X |
| 3,913,522 | 10/1975 | Light | 118/419 |
| 4,996,941 | 3/1991 | Mills | 156/579 X |
| 5,242,495 | 9/1993 | Hammond et al. | 156/575 X |
| 5,498,287 | 3/1996 | Barnfield | 156/575 X |

*Primary Examiner*—James Engel
*Attorney, Agent, or Firm*—John M. Harrison

[57] ABSTRACT

A drywall mud applicator which includes a bucket or container for containing a quantity of drywall mud, a pair of slots provided in the bottom of the bucket in oppositely-disposed relationship adjacent to the bottom of the bucket for receiving a feeder plate which operates to feed a length of drywall tape through the slots, a mud adjusting mechanism mounted on the bucket adjacent to one of the slots for receiving the mud-coated tape and facilitating cutting of the tape to a desired length for applying to a drywall panel and a tape dispenser mounted on the bucket for receiving a roll of drywall tape and facilitating feeding of the tape through the slots and the mud adjusting mechanism.

20 Claims, 4 Drawing Sheets

DRYWALL MUD APPLICATOR

BACKGROUND OF THE INVENTION

Field of the Invention

This invention relates to the application of drywall mud to the seams, cracks and spaces between mounted drywall panels for completing wall and ceiling surfaces. More particularly, the application relates to a drywall mud applicator which is designed to apply drywall mud on demand to a length of drywall tape extended through the applicator and facilitate cutting selected lengths of tape for application to the drywall panel seams, cracks and spaces in a conventional manner. In a preferred embodiment the drywall mud applicator of this invention is characterized by a bucket or container fitted with a pair of oppositely-disposed dispensing slots located near the bottom of the container and having a mud-adjusting mechanism mounted on the container adjacent to one of the slots. The bucket or container may be fitted with removable legs and a tape dispenser, the latter of which rotatably receives a roll of drywall tape and facilitates projection of the free end of the drywall tape into one of the slots in the container. A flat feeder plate is slidably disposed in the container and extends through the slots to facilitate projection of the free end of the drywall tape through the entry slot, exit slot and mud-adjusting mechanism, where it may be manually dispensed in selected lengths with a film of drywall mud applied in a thickness determined by adjustment of the mud-adjusting mechanism. A unique feature of the invention is the provision for storing the removable legs, tape dispenser, drywall tape and feeder plate in the bucket or container when the drywall mud applicator is not in use.

One of the problems associated with "taping and floating" drywall joints, seams and cracks in walls and ceilings is that of efficiently providing a selected length of drywall tape having a coating of drywall mud of desired thickness for application to the drywall panels. Conventional apparatus for achieving this end typically consists of a tray or container which is worn on the belt of a user and contains a supply of drywall mud, and a roll of drywall tape, also worn on the belt of the user. The tape is manually dispensed from a wire dispenser connected to the belt and extended through the drywall mud in the container for application of the drywall mud to the tape prior to application of the tape to the drywall panels. This system is cumbersome and difficult to master, since it requires considerable manual dexterity to remove a strip of tape of desired length from the roll and extend the tape through the drywall mud container to uniformly apply drywall mud to the tape in a desired thickness for application to the drywall panels. One of the significant problems associated with this technique using the indicated apparatus is that of uniformly applying drywall mud to the tape such that the tape will be securely applied to the drywall crack, space or seam and allow a smooth and efficient "floating" job. Another problem associated with conventional equipment of this and similar designs, is the requirement of periodically refilling the relatively small mud container, which requires additional time and is labor-intensive, thus adding to the cost of the job. A still further problem of utilizing the belt-mounted dispensing system is that of the necessity for removing the belt or exercising extreme caution not to spill the mud when the user is bending, squatting or stooping to perform various necessary functions on the job. Yet another problem is that of having to clean the drywall mud container before breaks, lunch or at the end of the day, to avoid contamination of the mud with dried mud particles.

Accordingly, it is an object of this invention to provide a new and improved drywall mud applicator which is designed to continuously apply drywall mud on a length of drywall tape in a uniform, consistent manner on demand, to facilitate application of the tape to cracks, joints and spaces between drywall panels in conventional fashion.

Another object of the invention is to provide a drywall mud applicator which is capable of containing a large quantity of drywall mud and coating drywall tape with a uniform, consistent coating, wherein the mud-coated drywall tape may be dispensed on demand from the drywall mud applicator in selected lengths for application to drywall panels in conventional manner.

Still another object of this invention is to provide a drywall mud applicator which is characterized by a bucket or container having opposed entry and exit slots located at or near the bottom thereof for receiving a length of drywall tape, wherein the drywall tape can be continuously coated with drywall mud and dispensed from the container in selected lengths for application to the drywall panels in a conventional manner.

Another object of this invention is to provide a drywall mud applicator which is characterized in a preferred embodiment by a bucket or container fitted with legs and having an entry slot and an opposing exit slot in the bucket wall adjacent to the bottom of the bucket and a trough-shaped feeder plate tray for receiving a sliding tape feeder and dispensing a length of drywall tape from a drywall tape dispenser mounted on the bucket or container, through the slots and through a mud-adjusting mechanism at the exit slot, to coat the drywall tape with a uniform layer of drywall mud and facilitate dispensing and cutting of the tape on demand by the operator.

SUMMARY OF THE INVENTION

These and other objects of the invention are provided in a new and improved drywall mud applicator which is characterized by a plastic bucket or container optionally fitted with removable legs and further having oppositely-disposed tape inlet and outlet slots located in the bucket wall near the bottom of the container; a feeder plate tray extending through the container and the slots; a mud-adjusting mechanism located on a feeder plate support bracket at one end of the feeder plate tray at the tape outlet slot; a tape dispenser located near the top of the container for rotatably receiving a roll of drywall tape and guiding the drywall tape into the tape inlet slot; and a flat, slotted tape feeder extending through the tape inlet and outlet slots and lying adjacent to the feeder plate tray for initially receiving the free end of the drywall tape and dispensing the drywall tape through the inlet and outlet slots and the mud-adjusting mechanism to facilitate further dispensing of the drywall tape with a uniform coating of drywall mud on at least one side thereof, through the mud-adjusting mechanism on demand for application to the drywall panels by an applicator.

BRIEF DESCRIPTION OF THE DRAWING

The invention will be better understood by reference to the accompanying drawings, wherein.

DESCRIPTION OF THE PREFERRED EMBODIMENTS

Figure 1:
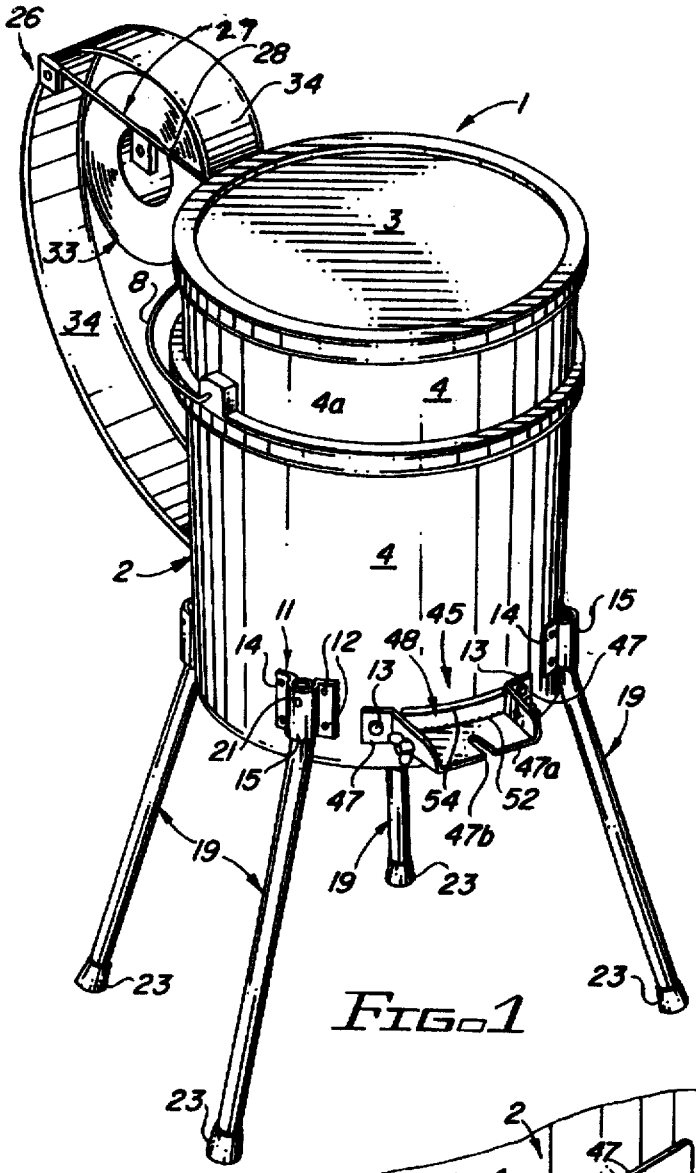
FIG. 1 is a perspective view of a preferred embodiment of the drywall mud applicator of this invention.
Figure 7:
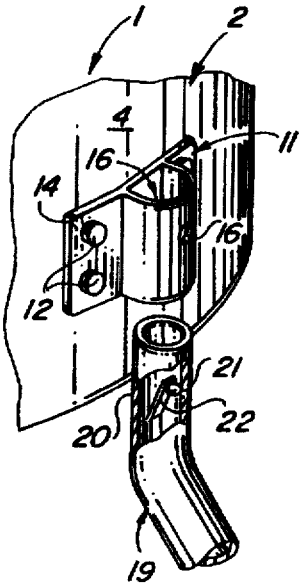
FIG. 7 is a perspective view of a leg bracket and leg positioned for removably mounting in the leg bracket.
Figure 9:
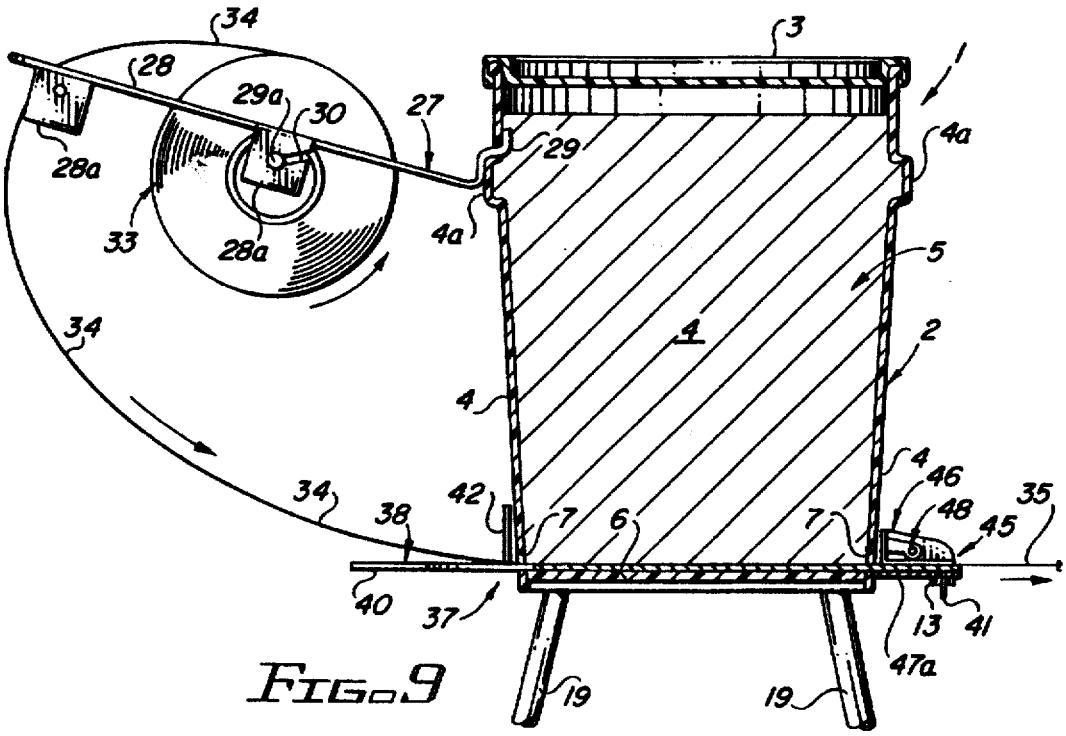
FIG. 9 is a side sectional view of the drywall mud applicator illustrated in FIG. 1.
Figure 13:
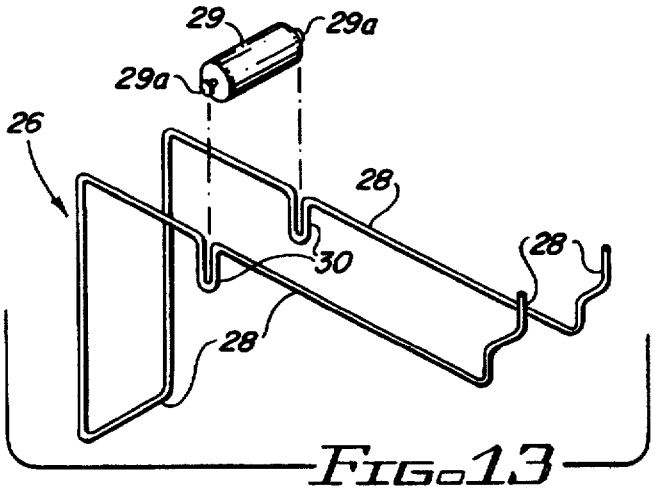
FIG. 13 is a perspective view of an alternative tape dispensing element.
Figure 12:
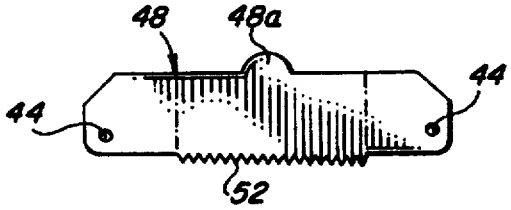
FIG. 12 is a front view of an alternative mud adjusting mechanism.

Referring now to FIGS. 1 and 9 of the drawings, in a preferred embodiment the drywall mud applicator of this invention is generally illustrated by reference numeral 1. The drywall mud applicator 1 is characterized by a bucket 2, having an optional lid 3 and a substantially cylindrical or slightly tapered bucket wall 4 extending from a flat bucket bottom 6. The bucket wall 4 may be provided with a wall flange 4*a* for stiffening and strengthening purposes, or may be smooth, as desired. The bucket wall 4 and bucket bottom 6 define a bucket interior 5 for containing a supply of drywall mud which is mixed to a selected consistency in conventional fashion for dispensing on a length of drywall tape 34, as hereinafter further described. A pair of oppositely-disposed tape feeder slots 7 are provided in the bucket wall 4 of the bucket 2 near the bucket bottom 6, as further illustrated in FIG. 9. An optional bucket handle 8 may be provided in the bucket wall 4, preferably at the wall flange 4*a*, for strengthening purposes, as desired. Four leg brackets 11 are attached by means of bracket flanges 14 to the bucket wall 4 near the bucket bottom 6 in spaced relationship around the circumference of the bucket wall 4, as further illustrated in FIGS. 1 and 7. In a preferred embodiment of the invention the bracket flanges 14 of the leg brackets 11 are bolted or riveted to the bucket wall 4 to removably or permanently attach the leg brackets 11 to the bucket wall 4. Under circumstances where the leg brackets 11 are removably secured to the bucket wall 4, bracket bolts 12 are used in this capacity, with cooperating nuts 13 threaded on the bracket bolts 12 in the bucket interior 5, as further illustrated in FIGS. 7 and 9. Substantially cylindrically-shaped leg receptacles 15 are shaped in or attached to the bracket flanges 14 of the leg brackets 11 and each include a leg receptacle opening 16, as also further illustrated in FIG. 7. Four legs 19, each having a short mount segment 20, are fitted with a spring-loaded button 21, mounted on a spring button plate 22 positioned inside the hollow interior of the mount segment 20 of the legs 19 and are adapted for insertion in the leg receptacles 15. When the mount segment 20 of each of the legs 19 is inserted in the respective leg receptacle 15, the respective buttons 21 register with the corresponding leg receptacle openings 16 by operation of the bias in the spring button plates 22, to removably secure the legs 19 in the respective leg receptacles 15, as further illustrated in FIG. 1. A rubber foot 23 may be provided on that portion of each of the legs 19 which extend from the mount segment 20 in angular relationship to facilitate a sturdy support of the bucket 2, as further illustrated in FIG. 1.

Figure 2:
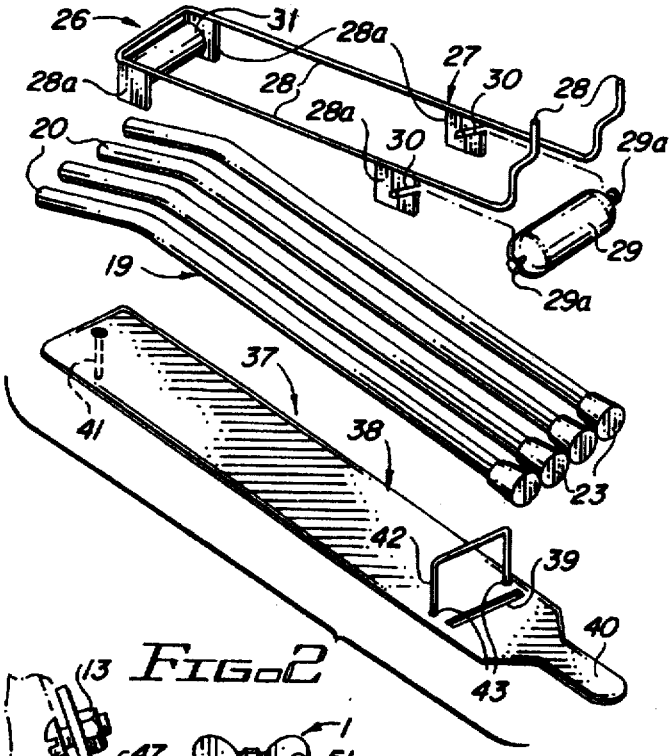
FIG. 2 is a perspective view of leg, tape feeder and tape dispenser elements of the drywall mud applicator.
Figure 5:
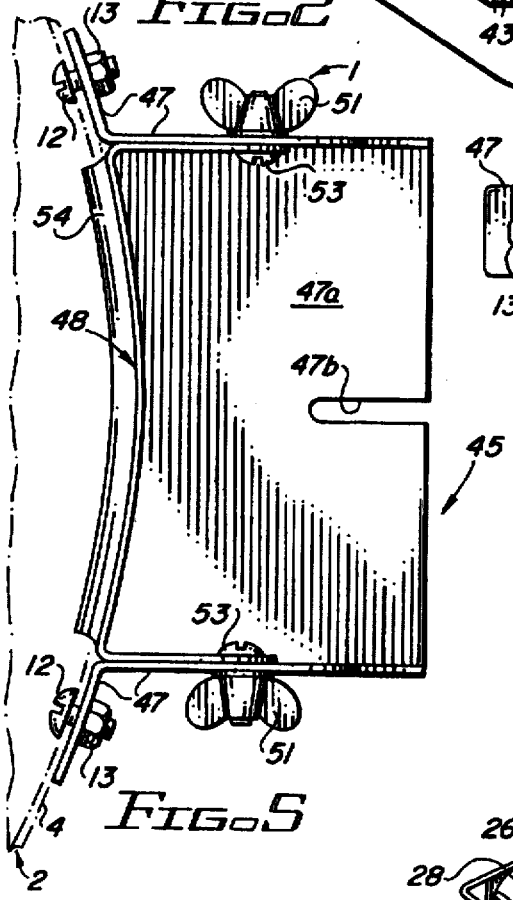
FIG. 5 is a top view of the mud-adjusting mechanism illustrated in FIGS. 3 and 4.
Figure 8:
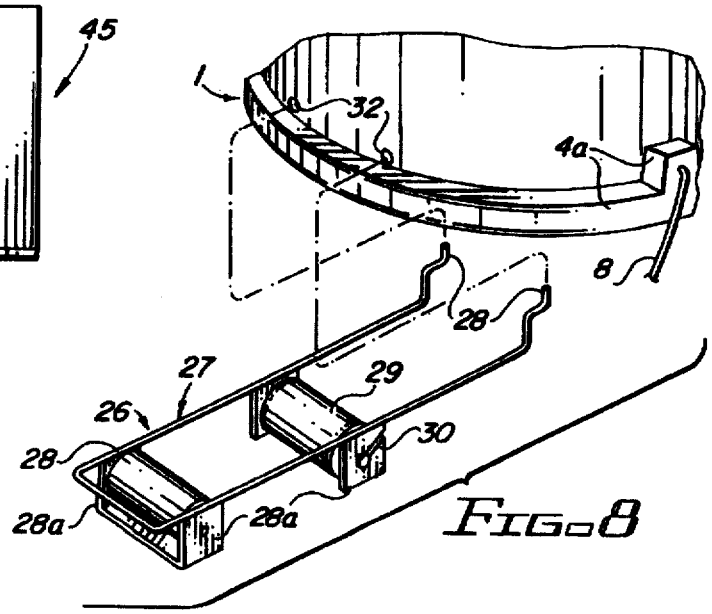
FIG. 8 is a perspective view of a tape dispenser element of the drywall mud applicator.

Referring now to FIGS. 1, 2 and 9 of the drawings, a tape dispenser 26 includes a dispenser frame 27, defined by a pair of parallel support rods 28 and two sets of parallel rod plates 28 disposed in spaced, parallel relationship with respect to each other on the support rods 28. The respective sets of rod plates 28*a* serve to mount a tape roller 29 and a guide roller 31, respectively, which tape roller 29 is removably mounted by means of roller pins 29*a* in a pair of roller mount slots 30, located in the rod plates 28*a* which are intermediate the ends of the support rods 28. The guide roller 31 is permanently and rotatably located in the rod plates 28*a* located at the extreme connected end of the support rods 28, as further illustrated in FIG. 2. The extending, unconnected ends of the support rods 28 are curved and shaped to engage a pair of mount openings 32 provided in the bucket wall 4 of the bucket 2, preferably located between the wall flange 4*a* and the top edge of the bucket 2, as illustrated in FIG. 8. Accordingly, a tape roll 33 of drywall tape 34 can be mounted on the tape roller 29 of the tape dispenser 26 by first removing the roller pins 29*a* in the tape roller 29 from the roller mount slots 30, placing the tape roll 33 on the tape roller 29 and then reinserting the roller pins 29*a* of the tape roller 29 in the roller mount slots 30, as illustrated in FIGS. 2 and 9. The tape roll 33 is thus allowed to roll on the tape roller 29 and the free end of the tape 34 is extended around the guide roller 31 and subsequently to the closest, or entry tape feeder slot 7, as illustrated in FIGS. 1 and 9. A flat, elongated feeder plate 38 of a tape feeder 37 is extended through the tape feeder slots 7, lies adjacent to the bucket bottom 6 and projects from each end of the tape feeder slots 7, as further illustrated in FIG. 9. The feeder plate 38 includes a plate slot 39 at one end and is shaped to define a plate handle 40 extending beyond the plate slot 39. A plate stop 41 is provided in the opposite end of the feeder plate 38 which projects from the outlet one of the tape feeder slots 7 and from a mud-adjusting mechanism 45, also as illustrated in FIG. 9. A U-shaped plate pin 42 is designed to be inserted in spaced pin openings 43 provided in the feeder plate 38 adjacent to the plate slot 39, for purposes which will be hereinafter further described.

Figure 3:
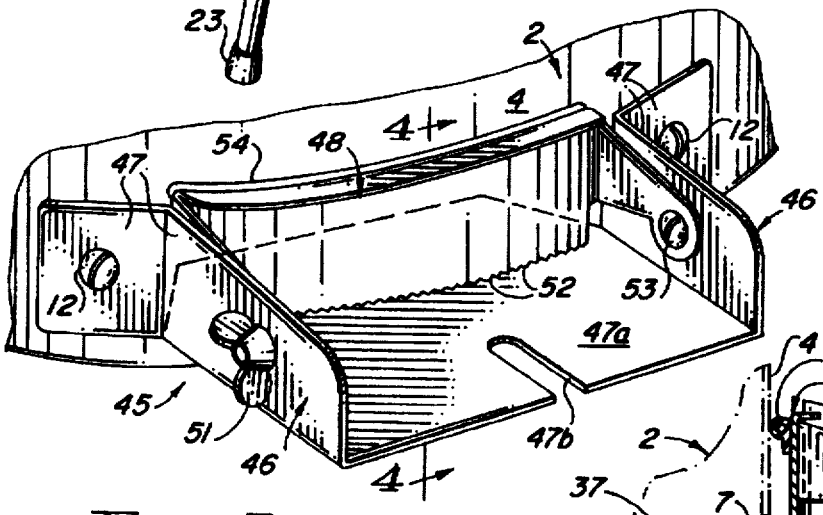
FIG. 3 is a perspective view of a mud-adjusting mechanism element of the drywall mud applicator.
Figure 6:
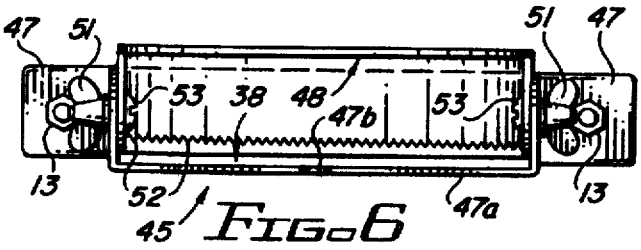
FIG. 6 is a front view of the mud-adjusting mechanism.

Referring now to FIGS. 1, 3–6 and 9 of the drawings the mud-adjusting mechanism 45 is located at the exit or outlet one of the tape feeder slots 7 and the mud-adjusting mechanism 45 is characterized by a feeder plate support bracket 46, shaped to define a pair of plate flanges 47, fitted with openings (not illustrated) for mounting the feeder plate support bracket 46 of the mud-adjusting mechanism 45 to the bucket wall 4 above the exit or outlet one of the tape feeder slots 7, as illustrated. A flat feeder plate 47*a*, fitted with a plate slot 47*b*, completes the feeder plate support bracket 46. Mounting of the feeder plate support bracket 46 to the bucket 2 is normally accomplished by using a pair of bracket bolts 12 and corresponding nuts 13, as further illustrated, but may be effected by pop rivets or other fastening techniques known to those skilled in the art. A pair of openings (not illustrated) are provided in the plate flanges 47 for receiving a pair of corresponding wing nut bolts 53 that extend through these openings and through aligned openings (not illustrated) provided in an adjusting flange 48, positioned between the apertured bracket flanges 47. The adjusting flange 48 has flange teeth 52 applied to the bottom edge thereof, lying adjacent to the outlet one of the tape feeder slots 7 and spaced from the feeder plate 47*a*, as illustrated in FIG. 3. A wing nut 51 is threaded on each of the projecting wing nut bolts 53 to facilitate pivotal movement of the adjusting flange 48 with respect to the plate flanges 47. This allows corresponding adjustment of the size of the opening between the feeder plate 38 of the tape feeder 37 and the flange teeth 52 disposed along the bottom edge of the adjusting flange 48, as illustrated in FIGS. 6 and 9. A resilient flange seal 54 is positioned on the adjusting flange 48 adjacent to the bucket wall 4 of the bucket 2 to seal the mud-adjusting mechanism 45 from leakage of drywall mud through the outlet one of the tape feeder slots 7.

Figure 4:
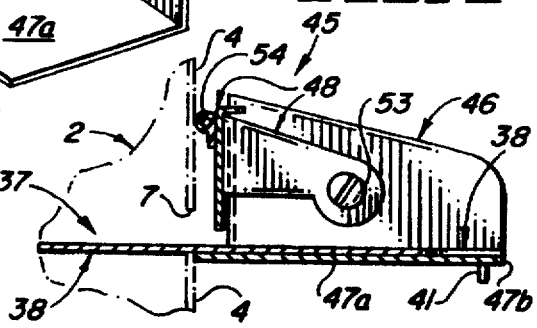
FIG. 4 is a side view of the mud-adjusting mechanism illustrated in FIG. 3.

Referring now to FIGS. 10–14 of the drawings in an alternative preferred embodiment of the invention the drywall mud applicator 1 includes an elongated, trough-shaped feeder plate tray 50 having a plate opening at one end and shaped to define a feeder plate support bracket 46, which is similar in shape to the feeder plate support bracket 46 illustrated in FIGS. 1, 3 and 4, heretofore described. Accordingly, the feeder plate tray 50 is designed to slide through the matching tape feeder slots 7 to the position illustrated in FIG. 14, wherein the bracket flanges 47 can be secured to the bucket wall 4 of the bucket 2 by means of suitable mount bolts 12, as in the case of the feeder plate support bracket 46 illustrated in FIGS. 1, 3 and 4. Under these circumstances, the opposite end of the feeder plate tray 50 from the feeder plate support bracket 46 projects beyond the corresponding tape feeder slot 7 to facilitate easy insertion of the tape feeder 37 through the tape feeder slot 7 and on the tray plate 50*a* between the plate flanges 50*b* of the feeder plate tray 50, as further illustrated in FIGS. 10 and 14. Accordingly, the free end of the tape 34 can be inserted in the plate slot 39 of the feeder plate 38 and extended through the bucket 2 and a drywall mud mix provided in the bucket 2, as hereinafter further described. As further illustrated in FIGS. 10, 12 and 14, the adjusting flange 48 includes a tab 48*a* to facilitate pivotal adjustment on the wing nut bolts 53, illustrated in FIG. 3, to adjust the thickness of drywall composition or compound which is deposited on the tape 34, as further hereinafter described.

Referring again to FIGS. 13 and 14 of the drawings in a most preferred embodiment of the invention the support rods 28 are fashioned from a single rod as illustrated and include proposed downwardly-extending loops that define roller mount slots 30 for receiving the roller pins 29*a* of a tape roller 29. The extending, spaced ends of the support rods 28 are designed to engage openings in the bucket 2 for supporting the tape dispenser 26 on the bucket 2 and a tape roll 33 rotatably on the removable tape roller 29, as heretofore described with respect to FIGS. 8 and 9 of the drawings.

Figure 14:
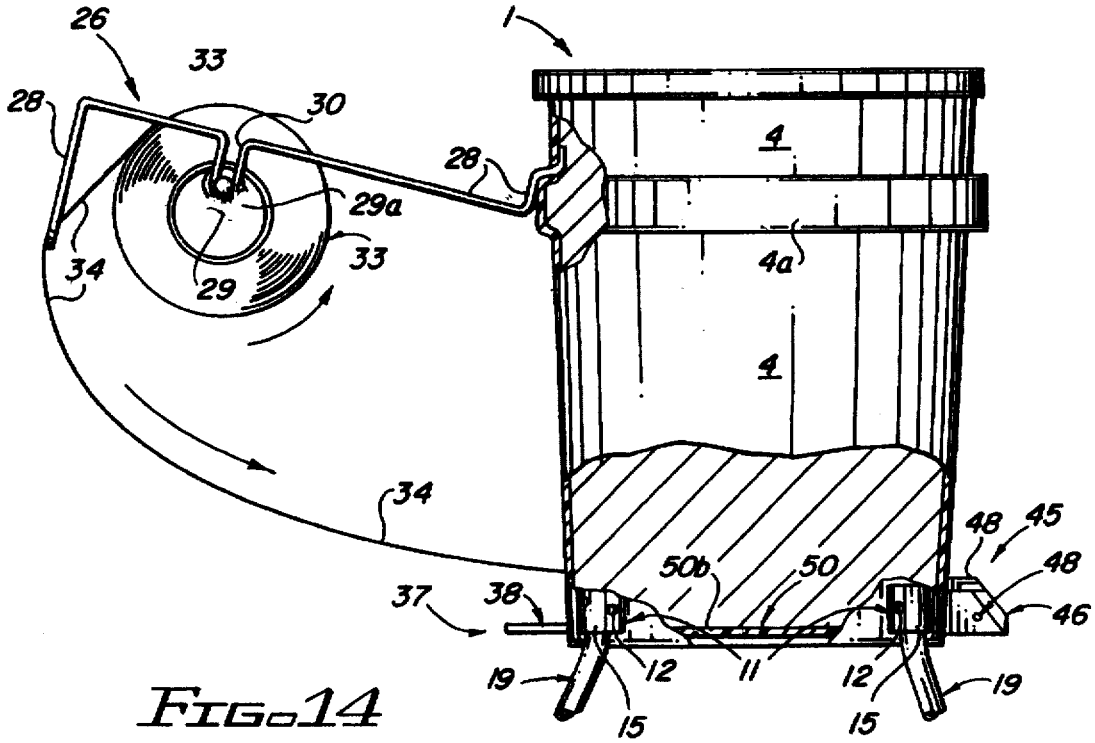
FIG. 14 is a side view, partially in section, of the container and assembled elements illustrated in FIGS. 10–13.

Referring now to FIG. 14 of the drawings when the feeder plate tray 50, adjusting flange 48 and tape dispenser 26 are assembled as illustrated, the drywall mud applicator 1 is in configuration for dispensing drywall mud on the tape 34 on demand by a user.

Figure 10:
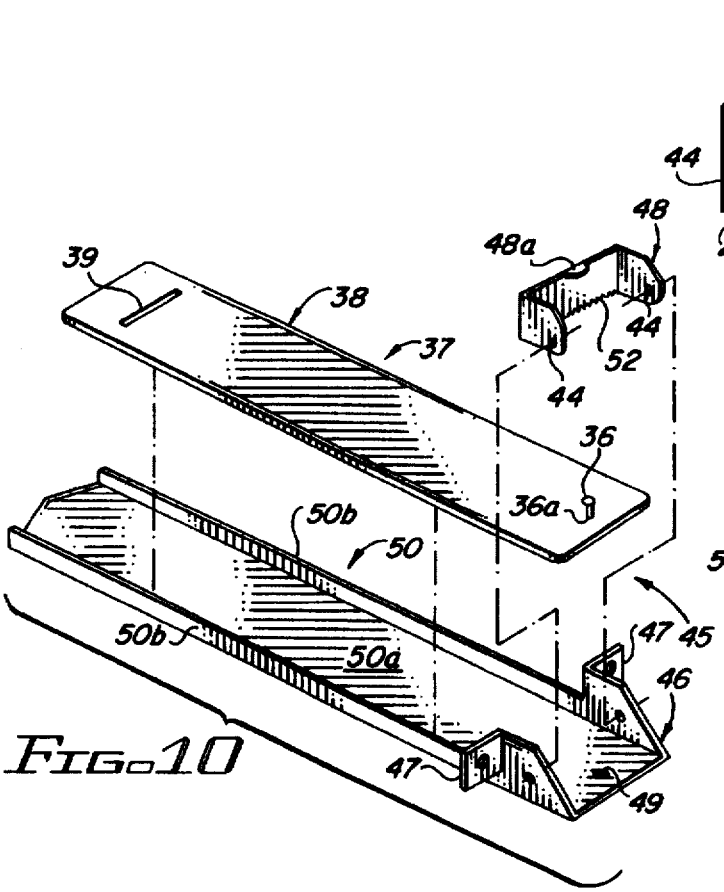
FIG. 10 is an exploded view of an alternative tape feeding mechanism, including a feeder plate tray for extension through the container and slots in the container and a tape feeder element cooperating with the feeder plate tray.
Figure 11:
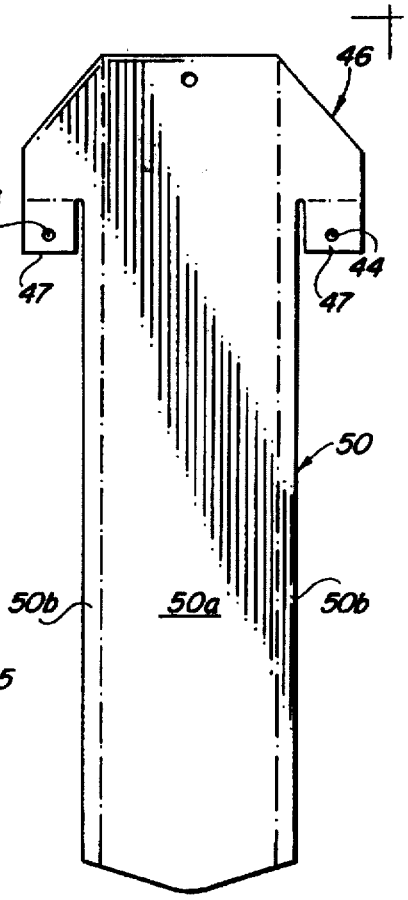
FIG. 11 is a top view of the feeder plate tray.

In operation, and referring again to FIGS. 1, 9 and 14 of the drawings, the drywall mud applicator of this invention is used as follows. The drywall mud applicator 1 is first assembled by initially removing the lid 3 from the bucket 2 and the legs 19, tape dispenser 26 and tape feeder 37 from the bucket interior 5 of the bucket 2. It will be appreciated that the bucket 2 is already fitted with the four leg brackets 11, and, in the embodiment illustrated in FIGS. 1 and 9, a mud-adjusting mechanism 45 at the exit or outlet one of the tape feeder slots 7. The legs 19 are then mounted in the respective leg brackets 11 by inserting the respective mount segments 20 into the corresponding leg receptacles 15, such that the spring-loaded buttons 21 correspond to and register with the corresponding leg receptacle opening 16 in each of the leg receptacles 15. This action removably locks the legs 19 onto the bucket 2 and facilitates orientation of the bucket 2 in elevated configuration on the legs 19, as shown in FIG. 1. The rubber feet 23 serve to prevent sliding of the bucket 2 on the supporting surface. The tape dispenser 26, in either of the embodiments illustrated in FIGS. 9 or 14, is then oriented such that the extending free ends of the support rods 28 are aligned with the corresponding mount openings 32 in the bucket wall 4 of the bucket 2, near the wall flange 4*a*, as illustrated in FIG. 8. These extending ends of the support rods 28 are then engaged with the mount openings 32 to orient the tape dispenser 26 in the position illustrated in FIG. 9. The roller pins 29*a* on the tape roller 29 are then removed from the corresponding roller mount slots 30, a tape roll 33 is placed on the tape roller 29 as heretofore described and the tape roller 29 is then re-inserted, with the roller pins 29*a* again seated in the roller mount slots 30, as illustrated in FIGS. 9 and 14. The free tape end 35 of the tape 34 is then unwound from the rotatably mounted tape roller 33 and is disposed around the guide roller 31 located at the connected ends of the support rods 28 of the tape dispenser 26 as illustrated in FIG. 1, or around the connecting segment of the support rods 28, as illustrated in FIG. 14. The tape 34 is then extended downwardly to the entry or inlet one of the tape feeder slots 7, as illustrated in FIGS. 9 and 14. The plate stop 41 in the feeder plate 38 of the tape feeder 37 is then removed and the flat feeder plate 38 is inserted in the inlet one of the tape feeder slots 7, through the interior of the bucket 2 adjacent to the bucket bottom 6 and through the outlet one of the tape feeder slots 7, also as illustrated in FIG. 9. In the embodiment illustrated in FIGS. 10–14, the feeder plate tray 50 is first inserted through the exit and inlet tape feeder slots 7 and the bracket flanges 47 are attached to the bucket 2 by means of mount bolts 12, extending through openings 44 in the bracket flange 47, as illustrated in FIG. 3. The adjusting flange 48 is then pivotally attached to the bracket flanges 47 by means of wing nut bolts 53 extending through the corresponding openings 44 in the bracket flanges 47 and the adjusting flange 48. The feeder plate 38 is then inserted in the inlet and exit tape feeder slots 7, on the tray plate 50*a* and between the plate flanges 50*b*, as illustrated in FIGS. 10 and 14. The plate stop 41 may then be reinserted in the corresponding opening in the end of the feeder plate 38 and extends through the plate slot 47*b* in the feeder plate 47*a* in the embodiment illustrated in FIG. 1. In this embodiment the U-shaped plate pin 42 is then aligned with the spaced pin openings 43 in the feeder plate 38 to stabilize the feeder plate 38 inside the bucket 2 of the drywall mud applicator 1. A nut 13 may also be threaded on the plate stop 41, as desired. In the embodiment illustrated in FIG. 14 a plate rivet 36 is loosely mounted in a rivet seat 36*a* in the feeder plate 38 and engages a rivet opening 49 in the feeder plate support bracket 46, for the same purpose. Drywall mud (not illustrated) is then mixed in the bucket 2 in conventional manner to a desired consistency and the adjusting flange 48 of the mud-adjusting mechanism 45 is adjusted with respect to the underlying feeder plate 38 of the tape feeder 37 by manipulating the wing nuts 51 on the corresponding wing nut bolts 53. This adjustment determines the thickness of a layer or film of drywall mud on the tape 34 which is dispensed on demand from the mud-adjusting mechanism 45, as hereinafter described. The lid 3 is then reapplied to the bucket 2 and the tape end 35 of the tape 34, wound on the tape roller 33, is inserted in the plate slot 39 of the feeder plate 38. The U-shaped plate pin 42 is then removed from the corresponding pin openings 43 in the embodiment illustrated in FIG. 1 and the feeder plate 38 is slidably pulled through the drywall mixture in the bucket 2, bringing the tape 34 with it, until the tape 34 exits the exit or outlet ones of the tape feeder slots 37 and the mud-adjusting mechanism 45 at the flange teeth 52. At this location, the end of the tape 34 is removed from the plate slot 39 of the feeder plate 38, grasped and extended further from the mud-adjusting mechanism 45. The feeder plate 38 is then slidably repositioned in the bucket 2 to the position illustrated in FIG. 9, where the plate pin 42 is reinserted in the corresponding spaced pin openings 43 and the nut 13 tightened on the optional plate stop 41, to again immobilize the feeder plate 38 in the bucket 2. The embodiment of the invention illustrated in FIG. 14 is similarly implemented. Accordingly, it will be appreciated by those skilled in the art that the feeder plate 38 of the tape feeder 37 serves to initially deploy the tape 34 through the respective tape feeder slots 7 and the mud-adjusting mechanism 45 for dispensing on demand by an operator. The tape 34 can then be dispensed through the bucket 2 along the supporting feeder plate 38 from the tape dispenser 26 as needed, with the adjustable space between the flange teeth 52 on the adjusting flange 48 of the mud-adjusting mechanism 45 and the feeder plate 38, serving to determine the film thickness of drywall mud remaining on the dispensed segments of tape 34. Desired lengths of premudded tape 34 can thus be dispensed from the drywall mud applicator 1 and torn at a selected length across the flange teeth 52 of the adjusting flange 48, for application in conventional fashion to the cracks, spaces and openings between the drywall panels of a wall or ceiling.

It will be appreciated by those skilled in the art that the drywall mud applicator of this invention is a compact, easy to use and efficient device for applying a layer of drywall mud of selected thickness on drywall tape for dispensing on demand by a user. Furthermore, as described above, the thickness of the drywall mud applied to the tape extending through the bucket 2 of the drywall mud applicator 1 can be adjusted by adjusting the adjusting flange 48 with respect to the feeder plate 38 by means of the wing nuts 51. Moreover, the drywall mud applicator 1 can be stored in a compact, easily accessible manner by simply removing the legs 19, tape dispenser 26 and tape feeder 37 from the bucket 2, placing the legs 19, tape dispenser 26, feeder plate tray 50 and the tape feeder 37 inside the plastic or metal bucket 2 and replacing the lid 3. Deployment can be easily effected by reversing this procedure according to the technique outlined above.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A drywall mud applicator for applying a layer of drywall mud on drywall tape dispensed from a tape roll, said drywall mud applicator comprising a container for containing a quantity of drywall mud; a pair of openings provided in said container in oppositely-disposed, spaced relationship with respect to each other; tape feeding means slidably disposed in said openings and extending through said container; tape dispensing means carried by said container for receiving the tape roll of drywall tape, with one end of the drywall tape engaging said tape feeding means, whereby the drywall tape is extended through said openings, the container and the drywall mud responsive to slidable manipulation of said tape feeding means, and the drywall tape with the layer of drywall mud are selectively dispensed from said container at one of said openings.

2. The drywall mud applicator of claim 1 comprising mud adjusting means provided on said container at said one of said openings for receiving said tape feeding means and the drywall tape and adjusting the thickness of the layer of drywall mud on the drywall tape responsive to selective dispensing of the drywall tape from said container.

3. The drywall mud applicator of claim 2 wherein said mud adjusting means comprises a feeder plate support bracket carried by said container at said one of said openings and an adjusting flange pivotally connected to said feeder plate support bracket for adjusting the distance between said adjusting flange and said tape feeding means.

4. The drywall mud applicator of claim 1 comprising a plurality of leg means provided on said container for supporting said container.

5. The drywall mud applicator of claim 4 wherein said leg means comprises a plurality of leg brackets attached to said container in spaced relationship with respect to each other and a plurality of legs removably engaging said leg brackets, respectively.

6. The drywall mud applicator of claim 4 comprising mud adjusting means provided on said container at said one of said openings for receiving said tape feeding means and the drywall tape and adjusting the thickness of the layer of drywall mud on the drywall tape responsive to selective dispensing of the drywall tape from said container on demand.

7. The drywall mud applicator of claim 6 wherein said mud adjusting means comprises a feeder plate support bracket carried by said container at said one of said openings and an adjusting flange pivotally connected to said feeder plate support bracket for adjusting the distance between said adjusting flange and said tape feeding means.

8. The drywall mud applicator of claim 7 wherein said leg means comprises a plurality of leg brackets attached to said container in spaced relationship with respect to each other and a plurality of legs removably engaging said leg brackets, respectively.

9. The drywall mud applicator of claim 8 comprising spring-loaded button means provided in each of said legs and a leg receptacle opening provided in each of said leg brackets for receiving said button means, respectfully, and removably securing said legs in said leg brackets.

10. A drywall mud applicator for applying a film of drywall mud of selected thickness on drywall tape dispensed from a roll of drywall tape, said drywall mud applicator comprising a container having a wall and a bottom, for containing a quantity of drywall mud; a pair of slots provided in said wall of said container in oppositely-disposed, spaced relationship with respect to each other near the bottom of said container; tape feeding support means extending through said slots; elongated tape feeding means slidably disposed in said slots and extending through said container and the drywall mud on said tape feeding support means; tape dispensing means carried by said container for receiving the roll of drywall tape, with one end of the drywall tape engaging said tape feeding means; and mud adjusting means provided on said tape feeding support means at one of said slots for receiving said tape feeding means and the drywall tape and adjusting the thickness of the layer of drywall mud on the drywall tape responsive to selective dispensing of the drywall tape from said container, whereby the drywall tape is extended through said slots, the container, the drywall mud and said mud adjusting means responsive to slidable manipulation of said tape feeding means, and the drywall tape is dispensed from said container, said one of said slots and said tape feeding means manually on demand.

11. The drywall mud applicator of claim 10 wherein said mud adjusting means comprises a feeder plate support bracket provided on said tape feeding support means and fixedly attached to said container at said one of said slots and an adjusting flange pivotally connected to said feeder plate support bracket for adjusting the distance between said adjusting flange and said tape feeding means.

12. The drywall mud applicator of claim 10 comprising a plurality of leg means provided on said container for supporting said container.

13. The drywall mud applicator of claim 12 wherein said leg means comprises a plurality of leg brackets attached to said container in spaced relationship with respect to each other and a plurality of legs removably engaging said leg brackets, respectively.

14. The drywall mud applicator of claim 10 wherein said mud adjusting means comprises a feeder plate support bracket provided on said tape feeding support means and fixedly attached to said container at said one of said slots and an adjusting flange pivotally connected to said feeder plate support bracket for adjusting the distance between said adjusting flange and said tape feeding means and comprising a plurality of leg means provided on said container for supporting said container.

15. The drywall mud applicator of claim 14 wherein said leg means comprises a plurality of leg brackets attached to said container in spaced relationship with respect to each other and a plurality of legs removably engaging said leg brackets, respectively.

16. A drywall mud applicator for applying a film of drywall mud of selected thickness on drywall tape, said drywall mud applicator comprising a container having a wall and a bottom, for containing a quantity of drywall mud; a pair of slots provided in said wall of said container in oppositely-disposed, spaced relationship with respect to each other near the bottom of said container; a feeder plate tray extending through said slots; an elongated tape feeder slidably disposed in said slots and extending through said container and the drywall mud on said feeder plate tray, with one end of the drywall tape engaging said tape feeder; and mud adjusting means provided on said feeder plate tray and secured to said wall of said container at one of said slots for receiving said tape feeder and the drywall tape and adjusting the thickness of the layer of drywall mud on the drywall tape responsive to selective dispensing of the drywall tape from said container, whereby the drywall tape is extended through the drywall mud, said slots and said mud adjusting means responsive to slidable manipulation of said tape feeder on said feeder plate tray and the drywall tape is dispensed from said container and said tape feeder manually on demand.

17. The drywall mud applicator of claim 16 comprising tape dispensing means removably mounted on said container for receiving the drywall tape and feeding the drywall tape through said slots responsive to manual dispensing of the drywall tape from said container and said mud adjusting means.

18. The drywall mud applicator of claim 16 wherein said mud adjusting means comprises a feeder plate support bracket fixedly carried by said feeder plate tray at said one of said slots and an adjusting flange pivotally connected to said feeder plate support bracket for adjusting the distance between said adjusting flange and said tape feeder.

19. The drywall mud applicator of claim 16 comprising a plurality of leg brackets attached to said container in spaced relationship with respect to each other and a plurality of legs removably engaging said leg brackets, respectively.

20. The drywall mud applicator of claim 17 wherein said mud adjusting means comprises a feeder plate support bracket fixedly carried by said feeder plate tray at said one of said slots and an adjusting flange pivotally connected to said feeder plate support bracket for adjusting the distance between said adjusting flange and said tape feeder and comprising a plurality of leg brackets attached to said container in spaced relationship with respect to each other, a plurality of legs removably engaging said leg brackets, respectively, and spring-loaded button means provided in each of said legs and a leg receptacle opening provided in each of said leg brackets for receiving said button means, respectfully, and removably securing said legs in said leg brackets.

* * * * *